US008062583B2

(12) United States Patent
Ishihara et al.

(10) Patent No.: US 8,062,583 B2
(45) Date of Patent: Nov. 22, 2011

(54) METHOD FOR PRODUCING SOFT MAGNETIC POWDERED CORE

(75) Inventors: Chio Ishihara, Matsudo (JP); Kazuo Asaka, Matsudo (JP); Kohei Muramatsu, Matsudo (JP); Tsuyoshi Akao, Kariya (JP); Hirotake Hamamatsu, Kariya (JP)

(73) Assignees: Hitachi Powdered Metals Co., Ltd., Matsudo (JP); Denso Corporation, Kariya (JP)

( * ) Notice: Subject to any disclaimer, the term of this patent is extended or adjusted under 35 U.S.C. 154(b) by 891 days.

(21) Appl. No.: 12/076,332

(22) Filed: Mar. 17, 2008

(65) Prior Publication Data

US 2008/0232995 A1 Sep. 25, 2008

(30) Foreign Application Priority Data

Mar. 19, 2007 (JP) ..... 2007-070878

(51) Int. Cl.

| | |
|---|---|
| ***B22F 1/00*** | (2006.01) |
| ***B22F 3/02*** | (2006.01) |
| *H01F 1/22* | (2006.01) |

(52) U.S. Cl. ..... 419/37; 419/65

(58) Field of Classification Search ..... 419/23, 419/37, 65, 66
See application file for complete search history.

(56) References Cited

U.S. PATENT DOCUMENTS

| | | | | |
|---|---|---|---|---|
| 7,211,158 | B2 * | 5/2007 | Ishihara et al. | 148/104 |
| 7,273,527 | B2 * | 9/2007 | Ishihara et al. | 148/104 |
| 2003/0047706 | A1 | 3/2003 | Mitani et al. | |
| 2005/0072950 | A1 | 4/2005 | Tojo et al. | |
| 2005/0242460 | A1 * | 11/2005 | Ishihara et al. | 264/122 |

FOREIGN PATENT DOCUMENTS

| | | |
|---|---|---|
| JP | A 11-251131 | 9/1999 |
| JP | A 2002-246219 | 8/2002 |
| JP | B2 3421944 | 6/2003 |
| JP | A 2004-146804 | 5/2004 |

* cited by examiner

*Primary Examiner* — George Wyszomierski
*Assistant Examiner* — Mark L Shevin
(74) *Attorney, Agent, or Firm* — Oliff & Berridge, PLC

(57) ABSTRACT

A method for producing a soft magnetic powdered core includes preparing a mixture of a soft magnetic powder and a resin powder, compacting the mixture into a predetermined shape so as to obtain a compact, and heating the compact. The resin powder has a median size of not more than 30 μm, a maximum particle size of not more than 100 μm, and a specific surface area of not less than 1.0 $m^2/cm^3$, and the additive amount thereof is 0.005 to 2 vol %.

3 Claims, No Drawings

METHOD FOR PRODUCING SOFT MAGNETIC POWDERED CORE

BACKGROUND OF THE INVENTION

1. Technical Field

The present invention relates to a technique for producing a soft magnetic powdered core, preferably used for soft magnetic motor cores, rotors and yokes of motors in home appliances and industrial instruments, solenoid cores (stator cores) for solenoid valves installed in an electronically controlled fuel injector for a diesel engine or a gasoline engine, and the like, which require high magnetic flux density.

2. Background Art

Iron loss is a very important consideration in soft magnetic cores used in various actuators; it is defined by eddy current loss relating to a specific electric resistivity value of a core and hysteresis loss affected by strain in a soft magnetic powder, which is generated in a production process of the soft magnetic powder and subsequent processing steps. The iron loss W can be specifically defined by a sum of eddy current loss, $W_e$, and hysteresis loss, $W_h$, as shown in the following formula (1). In the formula (1), the first term represents eddy current loss $W_e$, and the second term represents hysteresis loss $W_h$. In this case, "f" represents the frequency, "$B_m$" represents the exciting magnetic flux density, "ρ" represents the specific electric resistivity value, "t" represents the thickness of a material, and "$k_1$" and "$k_2$" represent coefficients.

Formula 1

$$W=(k_1B_m^2t^2/\rho)f^2+k_2B_m^{1.6}f \quad (1)$$

As is clear from the formula (1), while the hysteresis loss $W_h$ is proportional to the frequency f, the eddy current loss $W_e$ is proportional to the square of the frequency f. Therefore, in a high frequency area, decrease of the eddy current loss $W_e$ is effective in decreasing the iron loss W. In order to decrease the eddy current loss $W_e$, the specific electric resistivity value ρ should be increased so as to limit the eddy current in a small area. In this case, in a soft magnetic powdered core made from powder, for example, nonmagnetic resin can exist between soft magnetic powder particles such as iron powder. Therefore, the specific electric resistivity value ρ is increased, and the eddy current loss $W_e$ can thereby be decreased. A conventional technique for producing a soft magnetic powdered core is disclosed in Japanese Patent Application of Laid-Open No. 2002-246219, in which a mixture of a soft magnetic powder and a resin powder is used, and compacting and heating are performed. In the soft magnetic powdered core disclosed in Japanese Patent Application of Laid-Open No. 2002-246219, resin exists between soft magnetic powder particles, whereby electrical insulation between the soft magnetic powder particles is specifically ensured. As a result, the eddy current loss $W_e$ is decreased, and the soft magnetic powders are tightly bound, whereby strength of the soft magnetic powdered core is improved.

Conventionally, such a soft magnetic powdered core has been widely used because it is easily produced. When the above-described soft magnetic powdered core is used in a high frequency area, the electrical insulation is insufficient, whereby the specific electric resistivity value ρ is decreased, and the eddy current loss $W_e$ is increased. The increase in the eddy current loss $W_e$ causes heat generation, whereby resin binding the soft magnetic powders is deteriorated. Therefore, the soft magnetic powdered core has a disadvantage in that sufficient durability cannot be obtained. On the other hand, for example, when the resin amount is increased in order to improve the electrical insulation, the amount of the soft magnetic powder contained in the magnetic core (space factor) is decreased, whereby the magnetic flux density is decreased.

The soft magnetic powdered core may be used for electromagnetic actuators such as solenoids and motors. High attraction power and high responsiveness are required in an electromagnetic valve used in a fuel injector of a diesel engine. High magnetic flux density, high magnetic permeability, and small eddy current loss $W_e$ in a high frequency area are preferable in stator core materials using the soft magnetic powdered core. Such a solenoid core is a soft magnetic powdered core obtained by compacting a mixture of iron powder and resin powder, and it is required to have high density and to have favorable electrical insulation between iron powder particles so as to increase the magnetic flux density and to decrease the iron loss.

On the other hand, reduction in size and high efficiency are required in various motors, and high magnetic flux density and small eddy current loss $W_e$ in a high frequency area are preferable in rotor and stator materials using a soft magnetic powdered core. That is, required properties for a soft magnetic powdered core used in various electromagnetic actuators are substantially the same as those (specifically, iron loss) for a transformer core. In this case, a high magnetic flux density is required in the core of actuators because high attraction power is essential compared to the transformer core.

High density is necessary to obtain a soft magnetic powdered core with high magnetic flux density, and compacting pressure must be at least two times the pressure for producing ordinary sintered alloys. In a soft magnetic powdered core having a complicated shape or a thin shape, durability of a compacting die assembly would be deteriorated. Therefore, a soft magnetic powdered core having a shape similar to a solenoid core, a soft magnetic powdered core compacted to a simple cylindrical shape or a column shape is processed to have a predetermined shape and dimensions by machining. Alternatively, a soft magnetic powdered core compacted to a shape close to a product shape is machine finished at portions at which dimensional precision is specifically required. Therefore, the soft magnetic powdered core is required to have a good machinability, whereby wear of cutting tools can be minimal, and breakage and chipping of the material in machining can be prevented.

In view of the above circumstances, in order to decrease eddy current loss $W_e$ and improve magnetic flux density B, various methods have been suggested (for example, see Japanese Patent Application of Laid-Open No. 2002-246219, Japanese Patent No. 3421944, Japanese Patent Application of Laid-Open No. 11-251131, and Japanese Patent Application of Laid-Open No. 2004-146804). In these methods, eddy current loss $W_e$ is decreased by preliminary forming an insulating film on the surface of soft magnetic powders so as to ensure electrical insulation between the soft magnetic powder particles.

Since a magnetic flux density of a soft magnetic powdered core depends on the material density thereof, atomized iron powder is used as an iron powder so as to obtain high density, and the surface of the iron powder is coated with a film of phosphate compounds so as to decrease iron loss of the soft magnetic powdered core. As resin powders mixed with the iron powder, it is proposed to use a resin such as phenol, polyamide, epoxy, polyimide, and polyphenylenesulfide. For example, Japanese Patent Application of Laid-Open No. 2002-246219 discloses a soft magnetic powdered core obtained by adding 0.15 to 1 mass % of resin such as polyphenylenesulfide and thermosetting polyimide to atomized iron powders coated with phosphate compound. Japanese Patent No. 3421944 discloses a soft magnetic powdered core obtained by adding 2 mass % of thermosetting polyimide resin to atomized iron powder coated with phosphate compound. Moreover, in Japanese Patent Application of Laid-Open No. 11-251131, thickness of phosphate compound film is set to be not less than 10 nm and to be not more than 100 nm so that specific electric resistivity value ρ is not less than 2 Ocm and iron loss W is fixed. Furthermore, in Japanese Patent Application of Laid-Open No. 2004-146804, higher probability of resin powder existing between soft magnetic powder particles can be obtained by using resin powders having a small median size (median size of 30 μm or less), thereby obtaining soft magnetic powdered core having resin uniformly interposed between soft magnetic powder particles after heat treatment. The soft magnetic powdered core has eddy current loss $W_e$ which is sufficiently small even when magnetic flux density B is improved by decreasing an additive amount of resin powder to 0.01 to 5 vol %.

As mentioned above, in a soft magnetic powdered core, eddy current loss $W_e$ is decreased by improving electrical insulation, whereas magnetic flux density is improved by decreasing the additive amount of resin, and the soft magnetic powdered core has therefore been widely used recently. Furthermore, soft magnetic powdered cores, in which magnetic flux density is further improved while eddy current loss $W_e$ is small, are needed.

SUMMARY OF THE INVENTION

The present invention has been completed in view of the above demands. An object of the present invention is to provide a method for producing a soft magnetic powdered core in which electrical insulation is improved by uniformly interposing resin between soft magnetic powder particles. In the soft magnetic powdered core, eddy current loss $W_e$ in a high frequency area is decreased, whereby heat generation caused by the eddy current loss $W_e$ is decreased. As a result, durability of the soft magnetic core and performance of products using the soft magnetic powdered core are improved. Another object of the present invention is to provide a method for producing a soft magnetic powdered core in which magnetic flux density is sufficiently ensured by thinly interposing the resin between the soft magnetic powder particles, thereby improving the performance of products using soft magnetic powdered core.

The inventors have conducted intensive research based on the technique disclosed in Japanese Patent Application of Laid-Open No. 2004-146804 so as to solve the above-described problems. As a result, the inventors have focused attention on the shape of the resin powder, and they have found that eddy current loss $W_e$ can be efficiently decreased by using resin powder with irregular shapes. In this case, the eddy current loss $W_e$ is equivalent to that in a case in which ordinary resin powder is used, even when the additive amount is decreased. The inventors have further researched the irregularity of shape from the viewpoint of specific surface area based on the above findings, and the present invention has thereby been completed.

That is, the present invention provides a method for producing a soft magnetic powdered core comprising preparing a mixture of a soft magnetic powder and a resin powder, compacting the mixture into a predetermined shape so as to obtain a compact, and heating the compact. The resin powder has a median size of not more than 30 μm, a maximum particle size of not more than 100 μm, and a specific surface area of not less than 1.0 $m^2/cm^3$, and the additive amount thereof is 0.005 to 2 vol %. The resin powder preferably has a specific surface area of not less than 1.5 $m^2/cm^3$.

The particle size of the resin powder used in the present invention is set to have a median size of 30 μm (particle size at 50% of cumulative distribution) according to Japanese Patent Application of Laid-Open No. 2004-146804. A powder having a median size of not more than 30 μm is required so that the resin powder can be uniformly dispersed in soft magnetic powders when it is compacted, and so that the resin is uniformly interposed between the soft magnetic powder particles after heat treatment. On the other hand, when the powder has a median size of more than 30 μm, it is difficult to uniformly disperse resin powder in the soft magnetic powders. As a result, resin may be likely to be unevenly distributed in a soft magnetic powdered core, whereby specific resistance is decreased, and electrical insulation is decreased.

When the resin powder includes coarse powder particles, even if it has a median size of not more than 30 μm, the amount of resin is decreased at other portions according to the amount of the coarse powder particles, which is the same as in a case in which fine particles agglomerate. As a result, electrical insulation is decreased, and the space factor of the soft magnetic powder is decreased according to the amount of the coarse resin powder, whereby magnetic flux density is decreased. Therefore, the resin powder is required to have a maximum particle size of not more than 100 μm, and a maximum particle size of not more than 50 μm is preferable.

The resin powder in such a particle size range is set to have a specific surface area of not less than 1.0 $m^2/cm^3$, whereby additive amount of the resin powder can be decreased to 0.005 to 2 vol % so as to obtain a predetermined iron loss W (eddy current loss $W_e$). In this connection, ordinary resin powder has an approximately spherical shape due to the production method, and it has a specific surface area of approximately 0.1 to 0.3 $m^2/cm^3$. The resin powder having a specific surface area of not less than 1.0 $m^2/cm^3$ of the present invention can be obtained by forcibly crushing resin powders, which have a specific surface area of the above size and a large diameter, using jet mills, freeze crushers, and the like. The particle size of resin powder may be adjusted to have the above range by classifying such crushed resin powders.

It should be noted that a part of the range of the additive amount of resin powder in the present invention is the same as a part of the range of the additive amount of resin disclosed in Japanese Patent Application of Laid-Open No. 11-251131. The soft magnetic powdered core in the present invention includes resin powder having a specific surface area of not less than 1.0 $m^2/cm^3$. Therefore, even when the additive amount of the resin powders is the same, the soft magnetic powdered core of the present invention has a higher electrical insulation and a much smaller iron loss W (eddy current loss $W_e$), compared to those of a soft magnetic powdered core disclosed in Japanese Patent Application of Laid-Open No. 11-251131.

In the present invention, the surface of the soft magnetic powder may not be coated with insulating film, in contrast to that disclosed in Japanese Patent No. 3421944. When the surface of the soft magnetic powder is coated with an insulating film, a high degree of electrical insulation is ensured, and magnetic flux density may be further increased by decreasing the resin amount, thereby obtaining a soft magnetic powdered core having further improved properties.

In a soft magnetic powdered core obtained by the production method of the present invention, resin powder having a specific surface area of not less than 1.0 $m^2/cm^3$is used, whereby resin, the amount of which is less than that of conventional resin, can be uniformly and thinly interposed between soft magnetic powder particles. Therefore, eddy current loss $W_e$ in a high frequency area and related heat generation are decreased, whereby durability of the magnetic core may be improved and high magnetic flux density is obtained. Accordingly, the properties of products using such cores can be improved.

EXAMPLES

First Example

Commercially available (thermoplastic or thermosetting) polyimide powder (specific surface area: 0.3 $m^2/cm^3$) was prepared as a resin powder. Moreover, (thermoplastic or thermosetting) polyimide powders were prepared by changing crushing conditions so as to change the specific surface area from 0.5 to 5 $m^2/cm^3$ and to adjust the median size to 5 to 30 μm.

These (thermoplastic or thermosetting) polyimide powders were added at 0.3 vol % to electrically insulated iron powders, which were obtained by coating phosphate chemical conversion insulating film on the surface of pure iron powder, and they were mixed so as to obtain raw powder. The raw powder was compacted at a compacting pressure of 1470 MPa so as to obtain a ring-shaped compact having an inner diameter of 20 mm, an outer diameter of 30 mm, and a height of 5 mm. Then, the compact was heat-treated at 360° C. for 1 hour, and samples having sample numbers 01 to 21, shown in Table 1, were formed.

In these samples, magnetic flux density $B_{10000\ A/m}$(T) was measured under a magnetizing force of 10000 A/m as a direct-current magnetic property, hysteresis loss $W_h$ was measured at a frequency of 5 kHz and an exciting magnetic flux density of 0.25 T as an alternating-current magnetic property, and eddy current loss $W_e$ and iron loss W were measured. After the surfaces of the samples were polished with a sandpaper having No. 800 of abrasive grain size prescribed in JIS (Japanese Industrial Standard) R6001, specific electric resistivity value ρ was measured at the polished surface by a 4-point-probe method to measure electrical characteristics. These results are shown in Table 2.

TABLE 1

| Sample No. | Specific surface area ($m^2/cm^3$) | Median size (μm) | Maximum particle size (μm) | Additive amount (vol %) | Notes |
|---|---|---|---|---|---|
| 01 | 0.3 | 30.0 | 110 | 0.3 | Conventional example |

TABLE 1-continued

| Sample No. | Specific surface area ($m^2/cm^3$) | Median size (μm) | Maximum particle size (μm) | Additive amount (vol %) | Notes |
|---|---|---|---|---|---|
| 02 | 0.5 | 25.0 | 90 | 0.3 | Below lower limit of specific surface area |
| 03 | 1.0 | 8.3 | 50 | 0.3 | Lower limit of specific surface area |
| 04 | 1.5 | 5.0 | 16 | 0.3 | |
| 05 | 2.0 | 3.5 | 15 | 0.3 | |
| 06 | 3.0 | 2.5 | 10 | 0.3 | |
| 07 | 5.0 | 2.0 | 5 | 0.3 | |

TABLE 2

| Sample No. | Hysteresis loss $W_h$ ($kW/m^3$) | Eddy current loss $W_e$ ($kW/m^3$) | Iron loss W ($kW/m^3$) | Magnetic flux density $B_{10000\ A/m}$ (T) | Specific electric resistivity value ρ (μOcm) | Notes |
|---|---|---|---|---|---|---|
| 01 | 630 | 9000 | 9630 | 1.87 | 1000 | Conventional example |
| 02 | 630 | 7000 | 7630 | 1.87 | 1500 | Below lower limit of specific surface area |
| 03 | 630 | 3500 | 4130 | 1.86 | 3000 | Lower limit of specific surface area |
| 04 | 625 | 2800 | 3425 | 1.86 | 4000 | |
| 05 | 625 | 2500 | 3125 | 1.85 | 4800 | |
| 06 | 620 | 2400 | 3020 | 1.84 | 7500 | |
| 07 | 620 | 2200 | 2820 | 1.84 | 9000 | |

According to the samples having sample numbers 01 to 07 shown in Tables 1 and 2, the specific surface area is proportional to the specific electric resistivity value ρ, and the specific electric resistivity value ρ increases with the increase of the specific surface area of the resin powder. In the sample number 01 in which the specific surface area is 0.3 $m^2/cm^3$, the eddy current loss $W_e$ and the iron loss W are large. When the specific surface area of the resin powder is increased, the eddy current loss $W_e$ and the iron loss W are decreased. In the sample number 03 in which the specific surface area is 1.0 $m^2/cm^3$, the iron loss W is decreased to 4130 $kW/m^3$, which is approximately half of the iron loss W of the sample having sample number 01. When the specific surface area is at 1.5 $m^2/cm^3$ or more, the eddy current loss $W_e$ exhibits an approximately constant value, whereby the iron loss W also exhibits an approximately constant value. The iron loss W is suddenly increased when the specific electric resistivity value ρ is less than a certain value, which is the same as the findings disclosed in Japanese Patent Application of Laid-Open No. 11-251131. Therefore, according to the relationship of the specific surface area and the iron loss W (eddy current loss $W_e$), it is effective to set the specific surface area at 1.0 $m^2/cm^3$ or more (first aspect of the invention) in order to decrease the iron loss W to half of the conventional value. Moreover, it is preferable to set the specific surface area at 1.5 $m^2/cm^3$ or more (second aspect of the invention) so that the iron loss W (eddy current loss $W_e$) will be low and exhibit a certain value.

On the other hand, the magnetic flux density $B_{10000\ A/m}$ is slightly decreased by the increase of the specific surface area, but it exhibits an approximately constant value when the specific surface area of the resin powder is 1.5 $m^2/cm^3$ or more. The reason for the former is that the powder density is increased due to the irregular shape of the resin powder, compared to a case in which the resin powder has a spherical shape, whereby the distance between the soft magnetic powder particles is increased. The increase of the distance between the soft magnetic powder particles may cause the above-described increase of the specific resistivity ρ, that is, the decrease of the iron loss (eddy current loss $W_e$), and the decrease of the magnetic flux density $B_{10000\ A/m}$. On the other hand, even when the resin powder has a very irregular shape, the resin powder may be compressed at a corner by the compacting pressure, and the distance between the soft magnetic powder particles cannot be extended over the certain distance. Therefore, the magnetic flux density exhibits an approximately constant value when the specific surface area of the resin powder is 1.5 $m^2/cm^3$ or more. The decrease in the magnetic flux density due to the irregular shape of the resin powder is very small, and the influence of the additive amount of the resin powder to the magnetic flux density is larger than that of the irregular shape of the resin powder. Therefore, by defining the specific surface area to be 1.5 $m^2/cm^3$ or more as described above, a soft magnetic powdered core in which the iron loss W and the magnetic flux density $B_{10000\ A/m}$ are stable can be obtained.

Second Example

The (thermoplastic or thermosetting) polyimide powders having a specific surface area of 2.0 $m^2/cm^3$ in the First Example were used by adjusting the median size to 2 to 100 μm. These resin powders were added at 0.1 vol % to the soft magnetic powder used in the First Example, and they were mixed so as to obtain raw powder. Samples having sample numbers 08 to 12 shown in Table 3 were formed under the same conditions as that in the First Example by using the raw powder. In theses samples, the direct-current magnetic property, the alternating-current magnetic property, and the electrical properties were investigated under the same conditions as that in the First Example. The results are shown in Table 4. It should be noted that the results of sample number 05 in the First Example are also shown in Tables 3 and 4.

TABLE 3

| Sample No. | Specific surface area ($m^2/cm^3$) | Median size (μm) | Maximum particle size (μm) | Additive amount (vol %) | Notes |
|---|---|---|---|---|---|
| 08 | 2.0 | 2.0 | 35 | 0.3 | |
| 09 | 2.0 | 2.5 | 30 | 0.3 | |
| 10 | 2.0 | 3.0 | 20 | 0.3 | |
| 05 | 2.0 | 3.5 | 15 | 0.3 | |
| 11 | 2.0 | 30.0 | 50 | 0.3 | Upper limit of median size |
| 12 | 2.0 | 60.0 | 70 | 0.3 | Above upper limit of median size |

TABLE 4

| Sample No. | Hysteresis loss $W_h$ ($kW/m^3$) | Eddy current loss $W_e$ ($kW/m^3$) | Iron loss W ($kW/m^3$) | Magnetic flux density $B_{10000\ A/m}$ (T) | Specific electric resistivity value ρ (μOcm) | Notes |
|---|---|---|---|---|---|---|
| 08 | 630 | 2400 | 3030 | 1.85 | 4900 | |
| 09 | 625 | 2450 | 3075 | 1.85 | 4850 | |
| 10 | 630 | 2480 | 3110 | 1.85 | 4830 | |
| 05 | 625 | 2500 | 3125 | 1.85 | 4800 | |
| 11 | 630 | 3200 | 3830 | 1.85 | 3000 | Upper limit of median size |
| 12 | 645 | 9100 | 9745 | 1.84 | 1500 | Above upper limit of median size |

According to the samples having sample numbers 05 and 08 to 12 shown in Tables 3 and 4, the eddy current loss $W_e$ and the iron loss W are decreased as median size decreases. By using resin powder adjusted to have a median size of not more than 30 μm, the iron loss W is decreased to not more than 4000 $kW/m^3$, and a superior soft magnetic powdered core can be obtained.

Third Example

The (thermoplastic or thermosetting) polyimide powders having a specific surface area of 2.0 $m^2/cm^3$ in the First Example were used by adjusting the median size to 3.5 μm and the maximum particle size to 15 to 150 μm. These resin powders were added at 0.3 vol % to the soft magnetic powder used in the First Example, and they were mixed so as to obtain raw powder. Samples having sample numbers 13 to 15 shown in Table 5 were formed under the same conditions as that in the First Example by using the raw powder. In theses samples, the direct-current magnetic property, the alternating-current magnetic property, and the electrical properties were investigated under the same conditions as that in the First Example. The results are shown in Table 6. It should be noted that the results of sample number 05 in the First Example are also shown in Tables 5 and 6.

TABLE 5

| Sample No. | Specific surface area ($m^2/cm^3$) | Median size (μm) | Maximum particle size (μm) | Additive amount (vol %) | Notes |
|---|---|---|---|---|---|
| 05 | 2.0 | 3.5 | 15 | 0.3 | |
| 13 | 2.0 | 3.5 | 50 | 0.3 | |
| 14 | 2.0 | 3.5 | 100 | 0.3 | Upper limit of maximum particle size |
| 15 | 2.0 | 3.5 | 150 | 0.3 | Above upper limit of maximum particle size |

TABLE 6

| Sample No. | Hysteresis loss $W_h$ (kW/m$^3$) | Eddy current loss $W_e$ (kW/m$^3$) | Iron loss W (kW/m$^3$) | Magnetic flux density $B_{10000\,A/m}$ (T) | Specific electric resistivity value ρ (μOcm) | Notes |
|---|---|---|---|---|---|---|
| 05 | 625 | 2500 | 3125 | 1.85 | 4800 | |
| 13 | 630 | 2800 | 3430 | 1.86 | 3500 | |
| 14 | 640 | 3400 | 4040 | 1.86 | 3000 | Upper limit of maximum particle size |
| 15 | 645 | 8800 | 9445 | 1.87 | 1800 | Above upper limit of maximum particle size |

According to the samples having sample numbers 05 and 13 to 15 shown in Tables 5 and 6, in the sample having sample number 15 having the same median size as the other samples and coarse resin powder in which the maximum particle size is more than 100 μm, the probability of resin powder existing between the soft magnetic powder particles is decreased, whereby the electrical insulation is decreased. As a result, the specific electric resistivity value ρ is decreased, whereby the eddy current loss $W_e$ and the iron loss W are increased. On the other hand, compared to the sample having sample number 05 in which the maximum particle size is adjusted to 15 μm, in the samples having sample numbers 13 and 14, which include resin powder having a maximum particle size of not more than 100 μm, the specific electric resistivity value ρ is decreased, and the eddy current loss $W_e$ and the iron loss W are increased. The changes in the values of the samples having sample numbers 13 and 14 are not larger than those of the sample having sample number 15, which includes resin powder having a maximum particle size of more than 100 μm. Therefore, the maximum particle size of resin powder is preferably adjusted to not more than 100 μm, and it is more preferable that the maximum particle size be adjusted to not more than 50 μm.

Fourth Example

The (thermoplastic or thermosetting) polyimide powders having a specific surface area of 2.0 m$^2$/cm$^3$ in the First Example were used by adjusting the median size to 3.5 μm and the maximum particle size to 15 μm. These resin powders were added at 0.005 to 5 vol % to the soft magnetic powder used in the First Example, and they were mixed so as to obtain raw powder. Samples having sample numbers 16 to 25, shown in Table 7, were formed under the same conditions as that in the First Example by using the raw powder. For comparison, as conventional examples, the (thermoplastic or thermosetting) polyimide powders having a specific surface area of 0.3 m$^2$/cm$^3$ in the First Example were used by adjusting the median size to 30 μm and the maximum particle size to 100 μm. These resin powders were added at 0.005 to 5 vol % to the soft magnetic powder so as to form samples (sample numbers 26 to 35). In these samples, the direct-current magnetic property, the alternating-current magnetic property, and the electrical properties were investigated under the same conditions as that in the First Example. The results are shown in Table 8. It should be noted that the results of sample numbers 01 and 05 in the First Example are also shown in Tables 7 and 8.

TABLE 7

| Sample No. | Specific surface area (m$^2$/cm$^3$) | Median size (μm) | Maximum particle size (μm) | Additive amount (vol %) | Notes |
|---|---|---|---|---|---|
| 16 | 2.0 | 3.5 | 15 | 0.005 | Lower limit of additive amount |
| 17 | 2.0 | 3.5 | 15 | 0.01 | |
| 18 | 2.0 | 3.5 | 15 | 0.05 | |
| 19 | 2.0 | 3.5 | 15 | 0.1 | |
| 20 | 2.0 | 3.5 | 15 | 0.2 | |
| 05 | 2.0 | 3.5 | 15 | 0.3 | |
| 21 | 2.0 | 3.5 | 15 | 0.5 | |
| 22 | 2.0 | 3.5 | 15 | 1.0 | |
| 23 | 2.0 | 3.5 | 15 | 1.5 | |
| 24 | 2.0 | 3.5 | 15 | 2.0 | Upper limit of additive amount |
| 25 | 2.0 | 3.5 | 15 | 5.0 | Above upper limit of additive amount |
| 26 | 0.3 | 30.0 | 100 | 0.005 | Conventional example |
| 27 | 0.3 | 30.0 | 100 | 0.01 | Conventional example |
| 28 | 0.3 | 30.0 | 100 | 0.05 | Conventional example |
| 29 | 0.3 | 30.0 | 100 | 0.1 | Conventional example |
| 30 | 0.3 | 30.0 | 100 | 0.2 | Conventional example |
| 01 | 0.3 | 30.0 | 110 | 0.3 | Conventional example |
| 31 | 0.3 | 30.0 | 100 | 0.5 | Conventional example |
| 32 | 0.3 | 30.0 | 100 | 1.0 | Conventional example |
| 33 | 0.3 | 30.0 | 100 | 1.5 | Conventional example |
| 34 | 0.3 | 30.0 | 100 | 2.0 | Conventional example |
| 35 | 0.3 | 30.0 | 100 | 5.0 | Conventional example |

TABLE 8

| Sample No. | Hysteresis loss $W_h$ (kW/m$^3$) | Eddy current loss $W_e$ (kW/m$^3$) | Iron loss W (kW/m$^3$) | Magnetic flux density $B_{10000\ A/m}$ (T) | Specific electric resistivity value ρ (μOcm) | Notes |
|---|---|---|---|---|---|---|
| 16 | 620 | 3500 | 4120 | 1.87 | 3000 | Lower limit of additive amount |
| 17 | 625 | 2800 | 3425 | 1.87 | 4300 | |
| 18 | 620 | 2700 | 3320 | 1.86 | 4500 | |
| 19 | 625 | 2600 | 3225 | 1.85 | 4600 | |
| 20 | 625 | 2550 | 3175 | 1.85 | 4700 | |
| 05 | 625 | 2500 | 3125 | 1.85 | 4800 | |
| 21 | 630 | 2400 | 3030 | 1.84 | 5600 | |
| 22 | 635 | 2410 | 3045 | 1.83 | 5900 | |
| 23 | 640 | 2400 | 3040 | 1.82 | 7000 | |
| 24 | 650 | 2390 | 3040 | 1.80 | 10000 | Upper limit of additive amount |
| 25 | 670 | 2380 | 3050 | 1.65 | 24000 | Above upper limit of additive amount |
| 26 | 630 | 17000 | 17630 | 1.87 | 500 | Conventional example |
| 27 | 625 | 13500 | 14125 | 1.87 | 600 | Conventional example |
| 28 | 628 | 11200 | 11828 | 1.87 | 800 | Conventional example |
| 29 | 629 | 10000 | 10629 | 1.87 | 900 | Conventional example |
| 30 | 630 | 9300 | 9930 | 1.87 | 950 | Conventional example |
| 01 | 630 | 9000 | 9630 | 1.87 | 1000 | Conventional example |
| 31 | 630 | 8100 | 8730 | 1.85 | 1300 | Conventional example |
| 32 | 640 | 7200 | 7840 | 1.83 | 1500 | Conventional example |
| 33 | 650 | 6800 | 7450 | 1.80 | 1800 | Conventional example |
| 34 | 660 | 4300 | 4960 | 1.78 | 3000 | Conventional example |
| 35 | 670 | 3800 | 4470 | 1.60 | 4000 | Conventional example |

According to the samples having sample numbers 05 and 16 to 25 (examples of the present invention) and the samples having sample numbers 01 and 26 to 35 (conventional examples), in each case, the specific electric resistivity value ρ is decreased, and the eddy current loss $W_e$ and the iron loss W are increased in accordance with smaller additive amount of the resin powder. In addition, according to the increase of the additive amount of the resin powder, the space factor of the soft magnetic powder is decreased, and the magnetic flux density $B_{10000\ A/m}$ is thereby decreased. In this case, the electrical insulation of the sample having a specific surface area of 2.0 m$^2$/cm$^3$ (example of the present invention) is higher than that of the sample having a specific surface area of 0.3 m$^2$/cm$^3$ (conventional example). When the above samples in which the additive amount is same are compared, the sample having a specific surface area of 2.0 m$^2$/cm$^3$ (example of the present invention) shows higher specific electric resistivity value ρ than that of the other, whereby the eddy current loss $W_e$ and the iron loss W are smaller than that of the other. Therefore, in the sample having sample number 26 in which the additive amount of resin powder is 0.005 vol %, which is one of the samples having the specific surface area of resin powder of 0.3 m$^2$/cm$^3$ (conventional examples), the iron loss W is extremely increased. On the other hand, in the sample having sample number 16 in which the specific surface area of resin powder is 2.0 m$^2$/cm$^3$ and the additive amount of resin powder is 0.005 vol %, the iron loss W is not extremely increased and is in a possible range. In this case, the sample (sample number 25) in which the additive amount of resin powder is more than 2 vol %, which is one of the samples having a specific surface area of the resin powder of 2.0 m$^2$/cm$^3$, the magnetic flux density is extremely decreased.

As mentioned above, compared to a case in which a conventional resin powder having a small specific surface area is used, when a resin powder having a large specific surface area is used in the same amount as the conventional resin powder, a soft magnetic powdered core in which the electrical insulation is higher and the iron loss W is small can be obtained, and the magnetic flux density B thereof is approximately the same as that of a soft magnetic powdered core including the conventional resin powder. On the other hand, when a magnetic core is designed to have an iron loss W that is approximately the same as that of a conventional magnetic core, the additive amount of resin powder can be decreased, and the magnetic flux density B would be higher than that of the conventional magnetic core.

What is claimed is:

1. A method for producing a soft magnetic powdered core, comprising:

preparing a mixture of a soft magnetic powder and a resin powder;

compacting the mixture into a predetermined shape so as to obtain a compact; and heating the compact, wherein the resin powder is produced by forcibly crushing and classifying a resin powder, thereby obtaining a median particle size of not more than 30 μm, a maximum particle size of not more than 100 μm, and a specific surface area of not less than 1.0 m$^2$/cm$^3$, and an additive amount of the resin powder to the soft magnetic powder is 0.005 to 0.01 vol %.

2. The method for producing a soft magnetic powdered core according to claim 1, wherein the resin powder has a specific surface area of not less than 1.5 m$^2$/cm$^3$.

3. The method for producing a soft magnetic powdered core according to claim 1, wherein the resin powder has a maximum particle size of not more than 50μm.

* * * * *